United States Patent [19]

Carlsson et al.

[11] 4,219,973

[45] Sep. 2, 1980

[54] GRINDING MACHINE FOR CHAMFERING WORKPIECE END SURFACES

[75] Inventors: Bo Carlsson, Grabo; Stig Johansson, Kullavik, both of Sweden

[73] Assignee: Centro-Maskin Goteborg AB, Gothenburg, Sweden

[21] Appl. No.: 967,430

[22] Filed: Dec. 7, 1978

Related U.S. Application Data

[63] Continuation of Ser. No. 804,312, Jun. 7, 1977, abandoned.

[30] Foreign Application Priority Data

Jun. 11, 1976 [SE] Sweden ..... 7606680

[51] Int. Cl.[3] ..... B24B 5/18

[52] U.S. Cl. ..... 51/90; 51/99; 51/241 B

[58] Field of Search ..... 51/31, 33, 90, 99, 98 R, 51/215 R, 241 B; 53/52

[56] References Cited

U.S. PATENT DOCUMENTS

| | | | |
|---|---|---|---|
| 1,824,432 | 9/1931 | Hendry | 53/52 |
| 2,869,293 | 1/1959 | Howard | 51/241 B |
| 3,304,661 | 2/1967 | Maguire | 51/90 |
| 3,395,493 | 8/1968 | Bonin | 51/90 |
| 3,473,271 | 10/1969 | Sawyer | 51/241 B |
| 4,052,822 | 10/1977 | Obear | 51/99 |
| 4,144,867 | 3/1979 | Wachs | 51/241 B |

FOREIGN PATENT DOCUMENTS

| | | | |
|---|---|---|---|
| 1752149 | 5/1971 | Fed. Rep. of Germany . | |
| 2223712 | 1/1973 | Fed. Rep. of Germany | 51/90 |
| 1777361 | 3/1973 | Fed. Rep. of Germany | 51/90 |

*Primary Examiner*—Gary L. Smith
*Assistant Examiner*—Robert P. Olszewski
*Attorney, Agent, or Firm*—Thompson, Birch, Gauthier & Samuels

[57] ABSTRACT

The invention relates to a grinding machine for chamfering workpiece end surfaces and renders possible a high-capacity machine, which removes material from the workpiece end surfaces only to an amount necessary for obtaining a product acceptable for continued working. This is achieved thereby that the grinding pendulum is mounted pivotally in a pendulum mounting, which is rotatable about an axis substantially in parallel with the longitudinal axis of the workpiece, so that the grinding wheel is caused to perform a circular movement after the workpiece outline.

6 Claims, 2 Drawing Figures

GRINDING MACHINE FOR CHAMFERING WORKPIECE END SURFACES

This is a continuation, of application Ser. No. 804,312 filed June 7, 1977 now abandoned.

This invention relates to a grinding machine intended to chamfer the end surfaces of workpieces.

At steel production the steel ingots after rolling usually are cut to shorter pieces. The cutting normally is carried out by means of shears or saws whereby at the workpiece end surfaces burrs are formed which are undesirable as they render a continued working of the workpiece difficult.

Devices for deburring workpiece end surfaces are previously known. Some devices comprise internally conical grinding wheels, other devices have a pair of mutually fixed angular grinding wheels, which are caused to perform a circular movement about the workpiece end surface to deburr the same. In the case of a curved workpiece or an oblique workpiece end surface, there is a great risk that at deburring the workpiece end surface will be ground non-uniformly, which implies an unnecessary and undesired removal of material and, besides, requires more time than a removal of material only for deburring would require. At the known devices, furthermore, the grinding wheels have a tendency of showing a non-uniform wear, because grooves are formed in the wheels when several workpiece end surfaces with the same cross-section are ground. The grooves weaken the grinding wheels and reduce their grinding effect.

The present invention relates to a grinding machine for chamfering the end surfaces of workpieces, at which machine the aforesaid disadvantages are eliminated. This object is achieved thereby that the grinding machine has been given the characterizing features defined in the claims.

Figure 1:
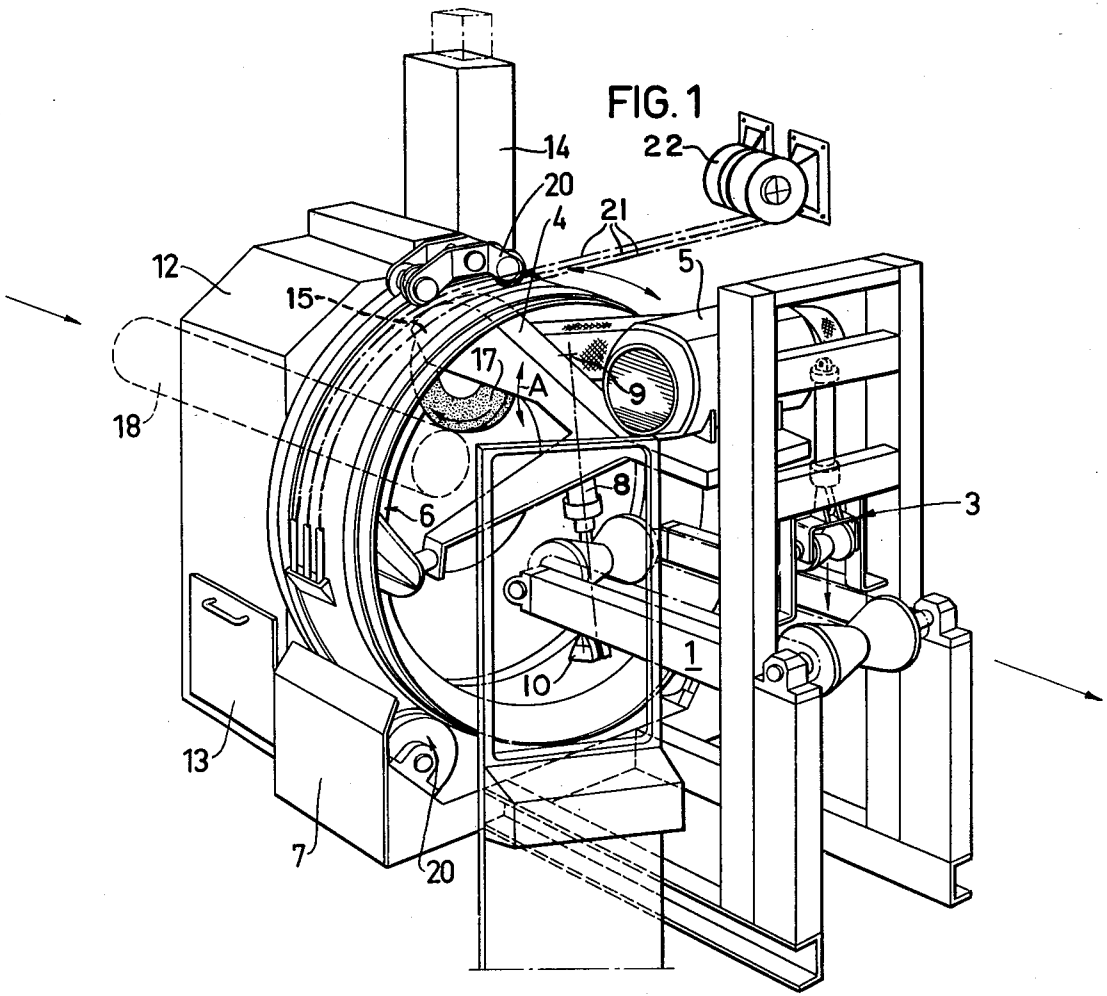
Figure 2:
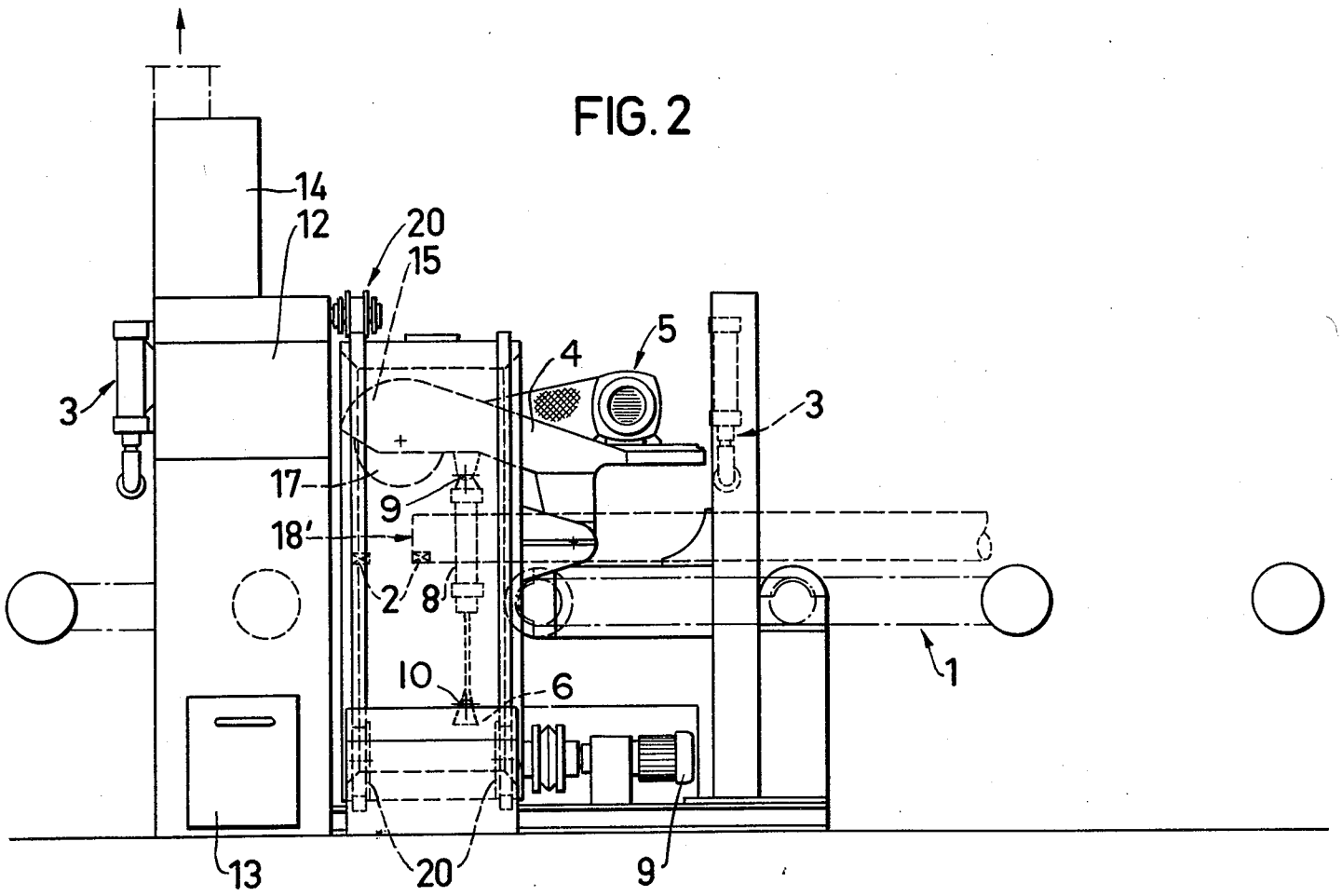

The invention is described in the following, with reference to an embodiment shown in the accompanying drawings, in which FIG. 1 is a perspective view of a grinding machine according to the invention, and FIG. 2 is a lateral view of the grinding machine according to FIG. 1.

The grinding wheel 17 of the grinding machine is supported on a grinding pendulum 4, which is rotatably pivoted in a pendulum mounting 6. A grinding pressure cylinder 8 is pivotally connected at 9 to the grinding pendulum 4 and at 10 to the pendulum mounting 6. A motor 5 for driving the wheel 17 also is arranged pivotally with the grinding pendulum 4 at the pendulum mounting 6. On the greater part about the circumference of the grinding wheel a burst protection 15 is provided on the grinding pendulum 4. A spatter sheet deflecting the grinding jet downwards during the working operation may possibly be provided at the grinding pendulum 4.

The grindiing pendulum 4 is adjacent to or enclosed in a housing 12 preventing spread of the grind dust. The heavy particles in the grinding dust drop down into a dust box 13 located beneath the grinding machine, while the grinding particles of light weight are evacuated through a duct 14 and possibly directed to a dust separator.

The pendulum mounting 6 is so mounted in several bearings 20, that it can rotate about its horizontal axis. The movement of the pendulum 4 takes place by rotation in one or several bearings of the pendulum mounting. The rotation of the pendulum mounting 6 preferably continues so that after rotation through a whole revolution, during which the end surface of the workpiece is chamfered, the direction of rotation is reversed during the chamfering of the next workpiece end surface. Hereby it is possible to transfer the energy to the grinding motor 5 and grinding pressure cylinder 8 via cables and hoses schematically depicted at 21 which are let out and retracted by a fixed reel 22.

The workpiece 18 is fed toward the grinding machine into grinding position on a roller conveyor. When the end of the workpiece 18 has assumed a position suitable for grinding, a photoelectric cell 2 is actuated, whereby the feed of the workpiece on the roller conveyor is stopped, and the workpiece 18 is clamped by means of a hydraulic cylinder 3. The workpiece end then is in a position where it can contact the grinding wheel where this is not covered by the burst protection 15. During the grinding operation the grinding pressure cylinder 8 holds the grinding wheel 17 against the workpiece end and permits an accurate tracking of the grinding wheel about the end section of the workpiece. When the workpiece end surfaces with square or rectangular cross-section are chamfered, thus, the grinding pendulum 4 will be rotated about the pivot in the pendulum mounting 6 by the action of the grinding pressure cylinder in such a manner, that a clockwise rotation, seen in FIG. 2, takes place when the grinding wheel approaches one corner of the end. This does not apply, however, to the workpiece shown in the Figures, which has circular cross-section. After the grinding wheel has passed the corner, a corresponding anti-clockwise rotation takes place until the wheel has assumed a position between two corners of the workpiece end. In order to avoid too high a grinding pressure at the passage of the corners, the grinding pressure cylinder possibly can be so disposed that the force therefrom is reduced after a certain clockwise deflection of the grinding pendulum 4. The reduction of the force from the grinding pressure cylinder 8, and the position where this reduction takes place, preferably can be adjusted according to the cross-sections of the workpieces to be chamfered at their ends. Hereby an unnecessary removal of material at the corners, caused by a reduced contact surface and a resulting higher grinding pressure, can be decreased.

At the embodiment the centre axis of the workpiece 18 is shown aligning with the axis of rotation of the pendulum mounting 6. It is to be observed, however, that the grinding machine also can treat workpieces, the centre axis of which lies offset in relation to the rotation axis of the pendulum mounting 6.

In FIG. 1 the direction of rotation of the pendulum mounting is indicated by the arrow B. The pivotal direction of the pendulum 4 is indicated by the arrow A.

A circular workpiece 18 is shown in FIG. 1 in a first position for chamfering the forward end edge. In FIG. 2 the position is shown, which the workpiece 18' occupies for chamfering its rear end edge.

The embodiment shown, thus, illustrates a grinding machine for chamfering workpiece end surfaces. The machine is of through type, i.e. the end surfaces of the workpiece are chamfered without the feed direction of the workpiece having to be changed and without the workpiece having to be turned.

What we claim is:

1. In a grinding machine for chamfering the end surfaces of an elongated workpiece, said machine having a rotatable grinding wheel carried on a pendulum which is in turn pivotally supported on a pendulum mounting, said pendulum mounting being rotatable in order to move said pendulum and the grinding wheel carried thereon around the longitudinal workpiece axis, the improvement comprising said pendulum being pivotally movable about an axis which is parallel to the rotational axis of the grinding wheel and which traverses the rotational axis of the pendulum mounting, the pendulum mounting having an opening through which the workpiece may be moved longitudinally along its axis, thereby enabling both ends of the workpiece to be chamfered by the grinding wheel without reversing or turning the workpiece.

2. The grinding machine according to claim 1 further comprising driven conveyor means for longitudinally moving the workpiece along its axis in order to locate the ends of the workpiece at an operative position within the range of said grinding wheel, photoelectric means responsive to the position of the workpiece ends for generating signals used to control the drive for said conveyor means, and hydraulic clamping means for clamping the workpiece on said conveyor means during the performance of a chamfering operation.

3. A machine according to claim 1, characterized in that a grinding pressure control cylinder is mounted pivotally between the grinding pendulum and the pendulum mounting.

4. A machine according to claim 3, characterized in that the energy transfer to the grinding motor and grinding pressure cylinder takes place via a cable and hose reel.

5. A machine according to claim 4, characterized in that the pendulum mounting is adapted to rotate only through one revolution in each direction from a central position.

6. A machine according to claim 3, characterized in that the force from the grinding pressure cylinder is adjustable according to the deflection of the grinding pendulum.

* * * * *